United States Patent [19]

Hildebrand et al.

[11] 4,089,739

[45] May 16, 1978

[54] HEAD BOX HAVING GUIDE BLOCK AND ADJUSTABLE SLICE PLATES

[75] Inventors: Otto Hildebrand, Ravensburg-Taldorf; Christoph Link, Ravensburg; Siegfried Reutter, Gerbertshaus; Wolf-Gunter Stotz, Ravensburg, all of Germany

[73] Assignee: Escher Wyss GmbH, Ravensburg, Wurtt, Germany

[21] Appl. No.: 760,959

[22] Filed: Jan. 21, 1977

[30] Foreign Application Priority Data

Jan. 27, 1976 Switzerland ..... 955/76

[51] Int. Cl.[2] ..... D21F 1/06

[52] U.S. Cl. ..... 162/343; 162/344; 162/346

[58] Field of Search ..... 162/336, 343, 346, 347, 162/344

[56] References Cited

U.S. PATENT DOCUMENTS

| | | | |
|---|---|---|---|
| 3,215,593 | 11/1965 | Green | 162/344 X |
| 3,909,349 | 9/1975 | Stotz et al. | 162/346 X |
| 3,962,031 | 6/1976 | Bubik et al. | 162/343 |

*Primary Examiner*—Richard V. Fisher

*Attorney, Agent, or Firm*—Kenyon & Kenyon, Reilly, Carr & Chapin

[57] ABSTRACT

The plates which define the throat of the head box are movable simultaneously to adjust the size of the exit throat while the angle between the plates is maintained. The adjusting means includes adjusting rods which are slidable lengthwise of the head box and transverse linkages which are pivotally secured to slidable locating members affixed to the plates. Adjusting screws at the throat provide a fine adjustment.

10 Claims, 4 Drawing Figures

HEAD BOX HAVING GUIDE BLOCK AND ADJUSTABLE SLICE PLATES

This invention relates to a head box for a paper making machine and, more particularly, to an adjustable nozzle duct for a head box of a paper-making machine.

Head boxes for paper-making machines are known in which a nozzle duct which terminates in a pulp exit throat is bounded by two lips with at least one lip being movable for adjustment of throat size. Head boxes of this kind are known, e.g. from German Auslegeschrift No. 1,905,078 (U.S. Pat. No. 3,578,556) and German Auslegeschrift No. 1,966,123 (U.S. Pat. No. 3,628,589). However, one disadvantage of head boxes in which just one of the lips is moved relative to the other in order to adjust the throat size is that the throat geometry varies with any adjustment. As a result, the throat surfaces which guide the flow of pulp or furnish experience an angular alteration of their position.

Accordingly, it is an object of the invention to provide a head box for a paper-making machine wherein the pulpguiding surfaces of the throat have the same angular position relative to one another in all positions.

It is another object of the invention to provide a head box which is much simpler than known top boxes.

Briefly, the invention provides a head box for a paper-making machine comprising means defining a flow path for a flow of pulp and a pair of plates, i.e. lip plates, defining a nozzle duct extending from said means and terminating in a pulp exit throat to discharge the pulp. Each plate has two parallel plane side surfaces and is movable therealong in a direction corresponding to the pulp flow direction. The plates define an acute angle with the throat disposed at the apex of the angle.

The means defining the flow path includes a distributor and a guide block of known construction while the plates are mounted on inclined side walls of the guide block.

An adjusting means is also provided for moving the plates simultaneously in the same direction and by the same amount while maintaining the angle between the plates.

The lip plates are moved via straight movements, so that the throat bounding ends always remain in the same angular position relative to one another. Further, the lip plates do not require any lateral space when they move away from one another to increase the size of the throat. Any demands on extra lateral space would be a disadvantage e.g. in cases in which the head box is disposed in a wedge-shaped nip or bight between two cylinders of a paper-making machine. It is conventional for the head box to be thus positioned e.g. in double-wire machines.

Because the adjusting means moves the lip plates simultaneously in the same direction and by the same amount, the lip plates always move in exactly symmetrical manner and thus do not cause lateral deflection of the stream of pulp leaving the throat.

The adjusting means includes locating members which are secured to the plates and guide members secured to the guide block for guiding the locating members. In order to move the locating members, mountings having bearings for adjusting rods are mounted on the guide block and the adjusting rods which are movable lengthwise of the head box and transversely of the pulp flow direction are pivotally connected to the associated lip plates by connecting linkages which extend transversely of the adjusting rods. Such an adjusting means which is known from U.S. Pat. No. 3,909,349 has the particular advantage of being a flat structure extending near the particular lip plate concerned. Such a structure takes up little space laterally of the head box. This feature is a great advantage when, as mentioned, the head box is to be placed in the wedge-shaped gap between two cylinders.

The guide members and the mountings can be secured to inclined side walls of the pulp guide block of the head box, the side walls being at the same angle to one another as the lip plates. This feature leads to a very compact head box construction. That is, no special support members are required which might otherwise extend along the whole head box transversely of the paper-making machine to carry one or more lip plates.

The pulp guide block side walls can be formed with ribs or grooves extending lengthwise of the pulp guide block while the guide members and mountings are formed with grooves or ribs adapted to the first-mentioned ribs or grooves respectively, for location of the guide parts and mountings on the side walls during assembly. Such a tongue and groove connection greatly simplifies head box assembly, since the guide members and the mountings need only be engaged by way of their respective grooves and ribs with the matching elements of the head box, no further adjustment being necessary.

The throat-bounding edges of the lip plates can be resilient opposite the locating members. In this case, adjusting screws are provided between the edge regions of the lip plates to permit a fine adjustment of the throat size. This feature makes it possible to have fine adjustment of the throat between the lips after assembly of the lip plates so that e.g. any distortion of the lip edges can be compensated for.

Advantageously, the lip plates and locating members can be so disposed on both sides of the pulp guide block that the locating members and adjusting screws are offset relative to one another on both sides. Consequently, the free length between discrete adjusting screws can be halved for a given number of locating members and adjusting screws, with the possibility of much more accurate adjustment.

These and other objects and advantages of the invention will become more apparent from the following detailed description and appended claims taken in conjunction with the accompanying drawings in which:

Figure 1:
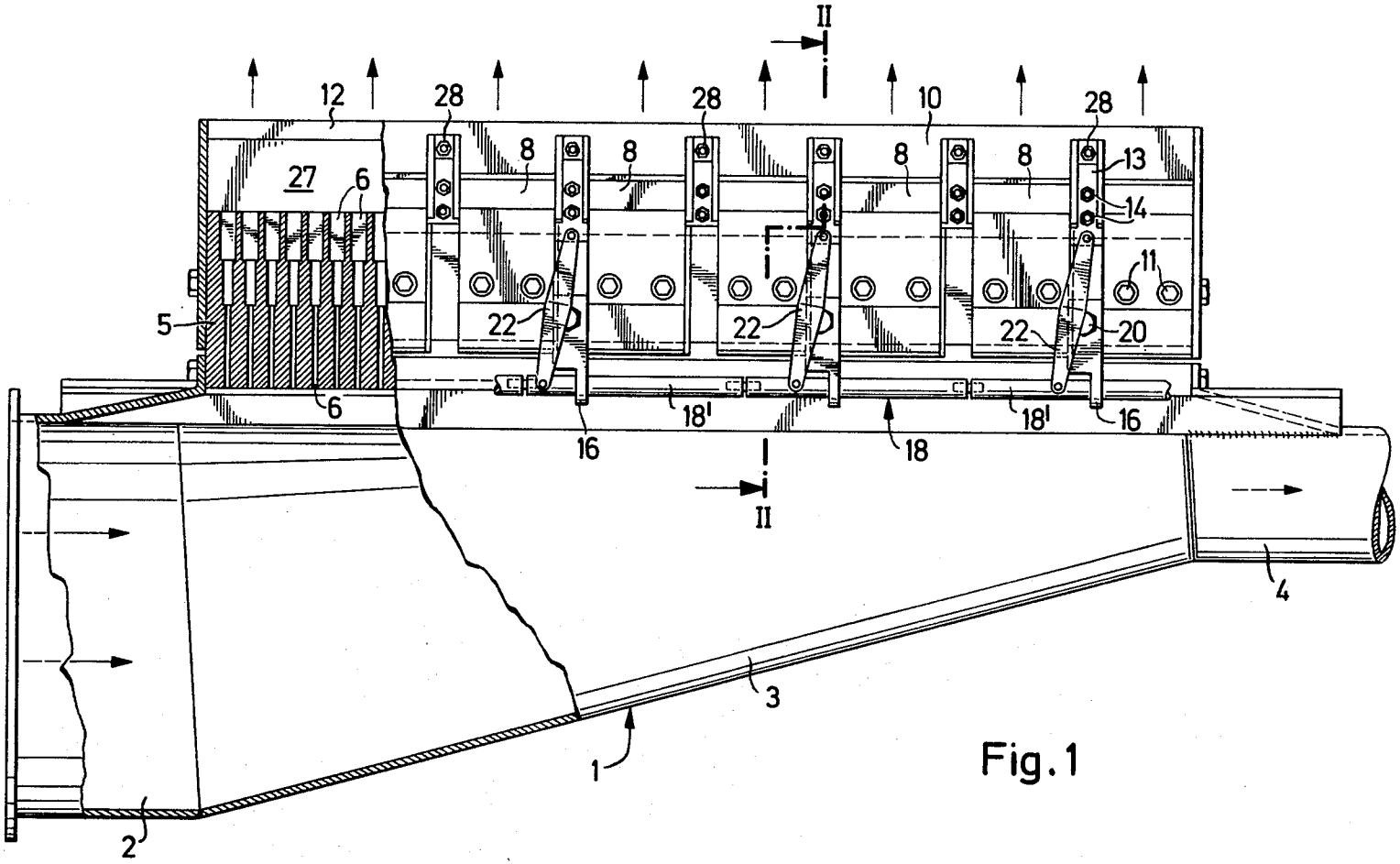
FIG. 1 illustrates a view with partial sectioning of a head box according to the invention.

Referring to FIG. 1, the head box has a distributor in the form of a distribution pipe 1 having a cylindrical portion 2, a conical portion 3 and a cylindrical overflow portion 4 for receiving a flow of pulp. The head box also has a pulp guide block 5 having ducts 6 for the pulp (or furnish or stock suspension or the like) which is connected to the conical portion 3 of the distributor 1. The ducts 6 widen stepwise in known manner. As can be gathered from FIGS. 1 and 2, the pulp guide block 5 takes the form of a metal block formed with the ducts 6.

As shown, the distributor 1 and block 5 form a means defining a flow path for the flow of pulp.

Figure 2:
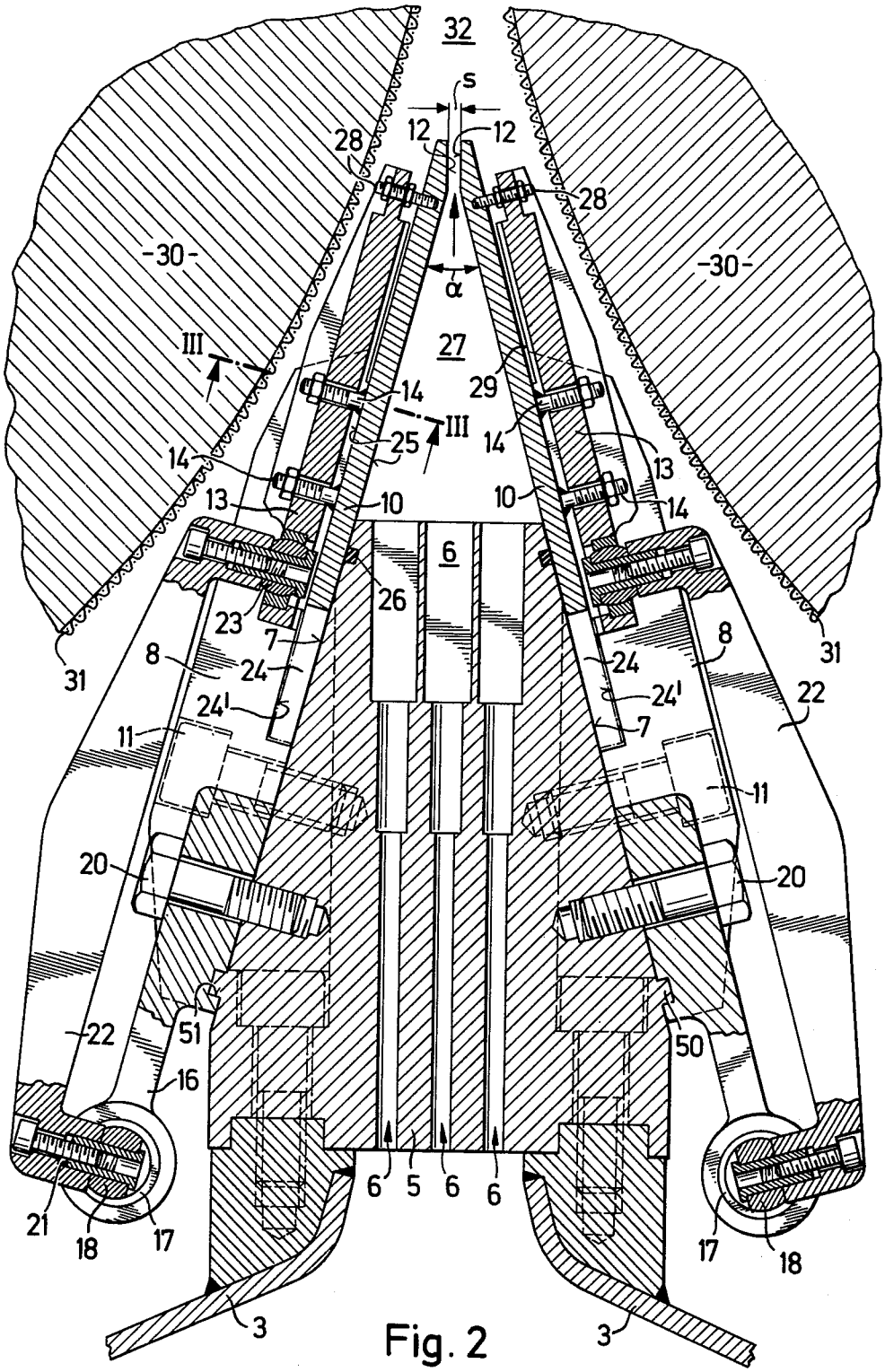
FIG. 2 illustrates a view taken on line II—II of FIG. 1 to an enlarged scale.
Figure 3:
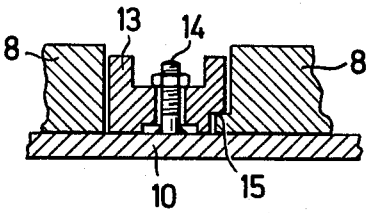
FIG. 3 illustrates a partial sectional view taken on line III—III of FIG. 2.

Referring to FIG. 2, the pulp guide block 5 has inclined side walls 7 to which guide members 8 of an adjusting means for a pair of lip plates 10 are secured by screws 11. The lip plates 10 cooperate to bound a pulp exit throat S. As shown, the throat S is bounded by two parallel surfaces 12 of the plates 10.

The adjusting means also has locating members 13 which are secured to the plates 10 by screw 14 and which serve to guide the plates 10 on stepped guide surfaces 15 of the guide members 8. In addition, mounting 16 having bearings 17 for adjusting rods 18 are secured by screws 20 to the pulp guide block 5 as extensions of the locating members 13. Each rod 18 is formed of segments 18' (FIG. 1) and is connected by pivot bearings 21 to connecting rods or linkages 22, the other ends of which are connected by pivots 23 to the locating members 13 and therefore to the associated lip plate 10. As shown, the connecting rods 22 are parallel to the plates 10.

As can also be seen in FIG. 2, the guide members 8 are formed with recesses 24 which cooperate with the pulp guide block side walls 7 to bound spaces adapted to receive the plates 10. The plane parallel side surfaces 25 of the plates are in movable bearing relationship on surfaces 24' of the guide member 8 against the pressure of the pulp. Cord packings or the like 26 are provided between the plates 10 and the block 5 to ensure sealtightness.

Also visible in FIG. 2 are two cylinders 30 over which wires 31 are trained. These cylinders 30 are parts of a double-wire machine in which the head box can be used. A very important consideration is that the head box throat S can be introduced very deeply into the wedge-shaped bight or nip 32 between the two cylinders 13.

In operation, pulp flows through the pipe 1 and ducts 6 into a narrowing nozzle duct 27 formed by the plates 10 and which terminates at the throat S. The inclined lip plates 10 together form an acute angle $\alpha$ with the throat S being at the apex of the angle $\alpha$. A thin stream of pulp emerges from the throat S and subsequently forms a fibrous fleece on the wires 31. The shape and relative position of the surfaces 12 determine satisfactory formation of the stream in the throat S and the direction of such stream. The surfaces 12 are shown diagrammatically in FIG. 2 as being plane parallel surfaces but they can be of any other appropriate shape.

In order to vary the size of the throat S, the adjusting rods 18 are moved lengthwise, the connecting rods 22 pivoting around their bearings 23 and correspondingly moving the members 13 and plates 10 to vary the size of the throat S.

Figure 4:
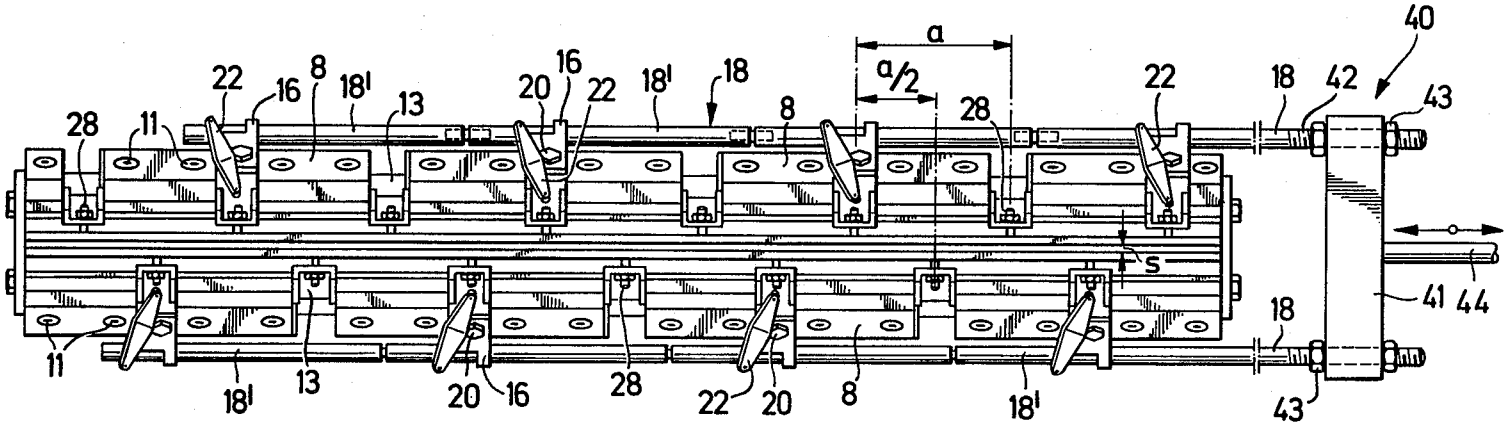
FIG. 4 illustrates a partial plane view corresponding to FIG. 1 showing an adjusting means for moving all the adjusting rods together.

An adjusting mechanism 40 of the kind shown in FIG. 4, wherein like reference characters indicate like parts as above, can be provided to ensure that the two adjusting rods 18 each make exactly the same movement. This mechanism 40 comprises a transverse member 41 from which a common adjusting rod 44 extends. The adjusting rods 18 have screwthreaded parts 42 on which nuts 43 are screwed to permit accurate adjustment of the rods 18 relative to the member 41.

By means of the mechanism 40, the two rods 18 and therefore the plates 10 can be adjusted in the same direction and by the same amount.

The adjusting means for the plates 10 also has adjusting screws 28 provided at the ends of the locating members 13 for fine adjustment of the lip plates 10 relative to the members 13 (FIG. 2). Also, a gap 29 is formed between the head end of each member 13 and the top part of the plate 10. The screws 28 permit accurate adjustment of the throat S along the head box to compensate for possible curvatures of the plates 10 and to ensure that the throat is, for instance, of the same size throughout.

If, as shown in FIG. 4, the plates 10 with their locating members 13 are offset from one another by half a division or "pitch" $a$ on both sides of the pulp guide block 5, the free length of the lip plate edges which is not influenced by the adjusting means is reduced to $a/2$, with a resulting considerable increase in adjustment accuracy.

Referring to FIG. 2, a tongue and groove connection is formed between each of the guide members 8 and a respective wall 7 and between each of the mountings 16 and a respective wall 7 to facilitate assembly of the head box and positioning of the various components. To this end, the pulp guide block walls 7 have ribs 50 which are adapted to grooves 51 in the members 8, 16. The ribs and grooves simplify head box assembly, since an accurate location of the guide members 8 and, more particularly, of the mountings 16 is provided just by engagement on the appropriate rib.

What is claimed is:

1. A head box for a paper-making machine comprising means defining a flow path for a flow of pulp, said means including a guide block having ducts therein and a pair of inclined side walls;

a pair of plates mounted on said guide block side walls to define a nozzle duct extending from said guide block, each said plate having a surface at one end opposite and parallel to a surface of the other of said plates to define a pulp exit throat to discharge the pulp, each said plate having two parallel plane side surfaces and being movable therealong in a direction corresponding to the pulp flow direction, said plates defining an acute angle with said throat disposed at the apex of said angle; and an adjusting means secured to said plates for moving said plates simultaneously by the same amount relative to said guide block while maintaining said angle therebetween.

2. A head box as set forth in claim 1, wherein said adjusting means includes linkages parallel to said plates for sliding said plates on said side walls.

3. A head box as set forth in claim 2 which further comprises guide members secured to said block for supporting said plates against the pressure of the pulp in said duct and locating members secured to said plates, said locating members being slidably mounted on said guide members.

4. A head box as set forth in claim 3 wherein said adjusting means further comprises a plurality of mountings having bearings therein, a plurality of adjusting rods slidably supported in said bearings longitudinally of said nozzle duct and transversely of the pulp flow, said linkages extending transversely of said adjusting rods, each said linkage being pivotally connected to a respective rod at one end and to a respective locating member at an opposite end.

5. A head box for a paper making machine comprising a distributor for receiving a flow of pulp;

a pulp guide block having ducts therein for uniformly distributing the flow of pulp from said distributor;

a pair of plates slidably mounted on said block to define a nozzle duct, each said plate having a surface at one end opposite and parallel to a surface of the other of said plates to define a pulp exit throat for discharging a uniform flow of pulp from said pulp guide onto at least one wire, said plates being disposed to define an angle therebetween; and an adjusting means secured to said plates for moving said plates simultaneously by the same amount relative to said guide block while maintaining said angle therebetween.

6. A head box as set forth in claim 5 wherein said adjusting means includes a locating member secured to a respective plate, a pair of guide members secured to said block and guiding said locating member therebetween, a mounting secured to said block and having a bearing therein, an adjusting rod slidably mounted in said bearing and extending therefrom, and a linkage pivotally connected between and to said adjusting rod and said locating member whereby upon movement of said adjusting rod in said bearing, said locating member moves said respective plate relative to said distributor to adjust the size of said throat.

7. A head box as set forth in claim 6 which further comprises an adjusting screw mounted on said locating member and threaded into a respective plate at said throat to adjust the size of said throat.

8. A head box for a paper-making machine comprising a pulp guide block having pulp ducts defining a flow path for a flow of pulp and inclined side walls;

a pair of plates defining a nozzle duct extending from said guide block and terminating in a pulp exit throat to discharge the pulp from said pulp ducts, each said plate being slidably mounted on a respective side wall and having two parallel plane side surfaces and being movable therealong in a direction corresponding to the pulp flow direction, said plates defining an acute angle with said throat disposed at the apex of said angle;

guide members for supporting said plates against the pressure of the pulp in said nozzle duct, each said member being mounted on a respective wall;

locating members secured to said plates, said locating members being slidably mounted on said guide members;

a plurality of mountings having bearings therein and being mounted on said walls;

a plurality of adjusting rods slidably supported in said bearings longitudinally of said nozzle duct and transversely of the pulp flow;

a plurality of linkages extending transversely of said adjusting rods, each said linkage being pivotally connected to a respective rod at one end and to a respective locating member at an opposite end; and a tongue and groove connection between each of said guide members and a respective wall and between each of said mountings and a respective wall.

9. A head box as set forth in claim 8 wherein said plates are resilient at said apex and which further comprises a plurality of adjusting screws for adjusting said plates relative to each other at said apex.

10. A head box as set forth in claim 9 wherein said locating members and said adjusting screws on one side of said block are offset from said locating members and said adjusting screws on the opposite side of said block.

* * * * *

UNITED STATES PATENT OFFICE

CERTIFICATE OF CORRECTION

Patent No. 4,089,739 Dated May 16, 1978

Inventor(s) Otto Hildebrand et al

It is certified that error appears in the above-identified patent and that said Letters Patent are hereby corrected as shown below:

Column 1, line 26, "top" should read -- head --.

Column 3, line 10, "screw" should read -- screws --.

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*